US008726863B2

(12) United States Patent
Meistrick et al.

(10) Patent No.: US 8,726,863 B2
(45) Date of Patent: May 20, 2014

(54) ROCKER SHAFT PEDESTAL INCORPORATING AN ENGINE VALVE ACTUATION SYSTEM OR ENGINE BRAKE

(75) Inventors: Zdenek S. Meistrick, West Granby, CT (US); Robert S. Perkins, East Granby, CT (US); Neil E. Fuchs, New Hartford, CT (US); Yan Dong, Chesire, CT (US); Steve Kacmarcik, Winchester Center, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 256 days.

(21) Appl. No.: 13/080,497

(22) Filed: Apr. 5, 2011

(65) Prior Publication Data

US 2011/0290206 A1 Dec. 1, 2011

Related U.S. Application Data

(63) Continuation-in-part of application No. 12/754,346, filed on Apr. 5, 2010, which is a continuation-in-part of application No. 12/611,297, filed on Nov. 3, 2009, which is a continuation-in-part of application No. 12/076,173, filed on Mar. 14, 2008, now Pat. No. 7,823,553.

(60) Provisional application No. 61/301,645, filed on Feb. 5, 2010, provisional application No. 60/895,318, filed on Mar. 16, 2007.

(51) Int. Cl.
*F01L 1/34* (2006.01)

(52) U.S. Cl.
USPC ..... 123/90.16; 123/90.15; 123/90.39

(58) Field of Classification Search
USPC ..... 123/90.22, 90.23, 90.25, 90.15, 9.36, 123/90.33, 90.39–90.47, 320, 90.12, 90.16
See application file for complete search history.

(56) References Cited

U.S. PATENT DOCUMENTS

| | | | | |
|---|---|---|---|---|
| 2,789,549 | A | 4/1957 | Brill | |
| 3,809,033 | A * | 5/1974 | Cartledge | 123/90.46 |
| 5,379,737 | A | 1/1995 | Hu | |
| 5,975,251 | A * | 11/1999 | McCarthy | 188/31 |
| 6,314,926 | B1 * | 11/2001 | Meneely et al. | 123/90.16 |
| 6,394,067 | B1 | 5/2002 | Usko et al. | |
| 6,439,195 | B1 * | 8/2002 | Warner | 123/321 |
| 6,694,933 | B1 | 2/2004 | Lester | |
| 2002/0174654 | A1 | 11/2002 | Yang | |
| 2005/0188966 | A1 | 9/2005 | Ruggiero et al. | |
| 2005/0252484 | A1 | 11/2005 | Vanderpoel et al. | |
| 2006/0005796 | A1 | 1/2006 | Janak et al. | |
| 2008/0223325 | A1 | 9/2008 | Meistrick | |

* cited by examiner

*Primary Examiner* — Kenneth Bomberg
*Assistant Examiner* — Wesley Harris
(74) *Attorney, Agent, or Firm* — Vedder Price PC

(57) ABSTRACT

A system for actuating an engine valve is disclosed. The system may include a rocker shaft having a hydraulic fluid supply circuit extending through the rocker shaft to a port on the outer surface of the rocker shaft and a solenoid valve adapted to selectively supply hydraulic fluid to the rocker shaft hydraulic fluid supply circuit. The rocker shaft may be supported by one or more rocker shaft pedestals. A lost motion housing may be incorporated into a rocker shaft pedestal and disposed about the rocker shaft. The lost motion housing may have an actuator piston assembly and a control valve assembly connected by an internal hydraulic circuit. The lost motion housing may be secured in a fixed position relative to the rocker shaft. External hydraulic fluid tubing may be provided between the solenoid valve and the control valve in the form of jumper tubes extending between adjacent rocker shafts or in the form of external hydraulic fluid tubes extending from control valve to control valve.

18 Claims, 17 Drawing Sheets

ROCKER SHAFT PEDESTAL INCORPORATING AN ENGINE VALVE ACTUATION SYSTEM OR ENGINE BRAKE

CROSS-REFERENCE TO RELATED APPLICATIONS

The present application is a continuation in part of, and claims the priority of U.S. patent application Ser. No. 12/754,346 filed Apr. 5, 2010 entitled "Individual Rocker Shaft and Pedestal Mounted Engine Brake," which relates to, and claims the priority of provisional application Ser. No. 61/301,645 filed Feb. 5, 2010 entitled "Individual Rocker Shaft and Pedestal Mounted Engine Brake," and which relates to, is a continuation in part of, and claims the priority of U.S. patent application Ser. No. 12/611,297 filed Nov. 3, 2009 entitled "Rocker Shaft Mounted Engine Brake," which is a continuation in part of, and claims the priority of U.S. patent application Ser. No. 12/076,173 filed Mar. 14, 2008 entitled "Engine Brake Having An Articulated Rocker Arm And A Rocker Shaft Mounted Housing," which relates to, and claims the priority of U.S. Provisional Patent Application Ser. No. 60/895,318 filed Mar. 16, 2007, which is entitled "Engine Brake Having an articulated Rocker Arm and a Rocker Shaft Mount Housing."

FIELD OF THE INVENTION

The present invention relates to a system and method for providing engine valve actuation for engine braking and positive power generation using an internal combustion engine.

BACKGROUND OF THE INVENTION

Internal combustion engines typically use either a mechanical, electrical, or hydro-mechanical valve actuation system to actuate the engine valves. These systems may include a combination of camshafts, rocker arms and push rods that are driven by the engine's crankshaft rotation. When a camshaft is used to actuate the engine valves, the timing of the valve actuation may be fixed by the size and location of the lobes on the camshaft.

For each 360 degree rotation of the camshaft, the engine completes a full cycle made up of four strokes (i.e., expansion, exhaust, intake, and compression). Both the intake and exhaust valves may be closed, and remain closed, during most of the expansion stroke wherein the piston is traveling away from the cylinder head (i.e., the volume between the cylinder head and the piston head is increasing). During positive power operation, fuel is burned during the expansion stroke and positive power is delivered by the engine. The expansion stroke ends at the bottom dead center point, at which time the piston reverses direction and the exhaust valve may be opened for a main exhaust event. A lobe on the camshaft may be synchronized to open the exhaust valve for the main exhaust event as the piston travels upward and forces combustion gases out of the cylinder. Near the end of the exhaust stroke, another lobe on the camshaft may open the intake valve for the main intake event at which time the piston travels away from the cylinder head. The intake valve closes and the intake stroke ends when the piston is near bottom dead center. Both the intake and exhaust valves are closed as the piston again travels upward for the compression stroke.

The above-referenced main intake and main exhaust valve events are required for positive power operation of an internal combustion engine. Additional auxiliary valve events, while not required, may be desirable. For example, it may be desirable to actuate the intake and/or exhaust valves during positive power or other engine operation modes for compression-release engine braking, bleeder engine braking, exhaust gas recirculation (EGR), or brake gas recirculation (BGR). FIG. 19 of co-pending application Ser. No. 11/123,063 filed May 6, 2005, which is hereby incorporated by reference, illustrates examples of a main exhaust event 600, and auxiliary valve events, such as a compression-release engine braking event 610, bleeder engine braking event 620, exhaust gas recirculation event 630, and brake gas recirculation event 640, which may be carried out by an exhaust valve using various embodiments of the present invention to actuate exhaust valves for main and auxiliary valve events.

With respect to auxiliary valve events, flow control of exhaust gas through an internal combustion engine has been used in order to provide vehicle engine braking. Generally, engine braking systems may control the flow of exhaust gas to incorporate the principles of compression-release type braking, exhaust gas recirculation, exhaust pressure regulation, full cycle bleeder and/or partial bleeder type braking.

During compression-release type engine braking, the exhaust valves may be selectively opened to convert, at least temporarily, a power producing internal combustion engine into a power absorbing air compressor. As a piston travels upward during its compression stroke, the gases that are trapped in the cylinder may be compressed. The compressed gases may oppose the upward motion of the piston. As the piston approaches the top dead center (TDC) position, at least one exhaust valve may be opened to release the compressed gases in the cylinder to the exhaust manifold, preventing the energy stored in the compressed gases from being returned to the engine on the subsequent expansion down-stroke. In doing so, the engine may develop retarding power to help slow the vehicle down. An example of a prior art compression release engine brake is provided by the disclosure of the Cummins, U.S. Pat. No. 3,220,392 (November 1965), which is hereby incorporated by reference.

During bleeder type engine braking, in addition to, and/or in place of, the main exhaust valve event, which occurs during the exhaust stroke of the piston, the exhaust valve(s) may be held slightly open during remaining three engine cycles (full-cycle bleeder brake) or during a portion of the remaining three engine cycles (partial-cycle bleeder brake). The bleeding of cylinder gases in and out of the cylinder may act to retard the engine. Usually, the initial opening of the braking valve(s) in a bleeder braking operation is in advance of the compression TDC (i.e., early valve actuation) and then lift is held constant for a period of time. As such, a bleeder type engine brake may require lower force to actuate the valve(s) due to early valve actuation, and generate less noise due to continuous bleeding instead of the rapid blow-down of a compression-release type brake.

Exhaust gas recirculation (EGR) systems may allow a portion of the exhaust gases to flow back into the engine cylinder during positive power operation. EGR may be used to reduce the amount of $NO_x$ created by the engine during positive power operations. An EGR system can also be used to control the pressure and temperature in the exhaust manifold and engine cylinder during engine braking cycles. Generally, there are two types of EGR systems, internal and external. External EGR systems recirculate exhaust gases back into the engine cylinder through an intake valve(s). Internal EGR systems recirculate exhaust gases back into the engine cylinder through an exhaust valve(s). Embodiments of the present invention primarily concern internal EGR systems.

Brake gas recirculation (BGR) systems may allow a portion of the exhaust gases to flow back into the engine cylinder during engine braking operation. Recirculation of exhaust gases back into the engine cylinder during the intake and/or early compression stroke, for example, may increase the mass of gases in the cylinder that are available for compression-release braking. As a result, BGR may increase the braking effect realized from the braking event.

SUMMARY OF THE INVENTION

Applicants have developed an innovative system for actuating one or more engine valves, comprising: a rocker shaft having a hydraulic fluid supply circuit extending through the rocker shaft to a port on the outer surface of the rocker shaft; a solenoid valve adapted to selectively supply hydraulic fluid to the rocker shaft hydraulic fluid supply circuit; a lost motion housing disposed about the rocker shaft, said lost motion housing having a lower pedestal adapted to contact a cylinder head, an actuator piston bore, a control valve bore, and an internal hydraulic circuit extending from the actuator piston bore to the control valve bore and from the control valve bore to the port on the outer surface of the rocker shaft; means for securing the lost motion housing in a fixed position relative to the rocker shaft; an actuator piston assembly disposed in the actuator piston bore; a control valve assembly disposed in the control valve bore; and external hydraulic fluid tubing provided between the solenoid valve and the control valve.

Applicants have further developed an innovative system for actuating one or more engine valves comprising: a plurality of rocker shafts, each of said rocker shafts having a hydraulic fluid supply circuit extending through the rocker shaft to a port on the outer surface of the rocker shaft; a plurality of lost motion housings, each of said plurality of lost motion housings comprising a rocker shaft pedestal and being disposed about a respective one of the plurality of rocker shafts, each of said lost motion housings having a collar surrounding a respective one of the plurality of rocker shafts, a lower pedestal portion adapted to contact a cylinder head, an actuator piston bore, a control valve bore, and an internal hydraulic circuit extending from the actuator piston bore to the control valve bore and from the control valve bore to the port on the outer surface of the rocker shaft; means for securing each of the plurality of lost motion housings in a fixed position relative to a respective one of the plurality of rocker shafts; a plurality of actuator piston assemblies, each disposed in a respective one of the actuator piston bores; a plurality of control valve assemblies, each disposed in a respective one of the control valve bores; a solenoid valve; a T-jumper tube extending between a first and second of the plurality of rocker shafts and the solenoid valve, said T-jumper tube having an internal hydraulic passage providing hydraulic communication between the hydraulic fluid supply circuits of the first and second of the plurality of rocker shafts and the solenoid valve; and a straight jumper tube extending between the second and a third of the plurality of rocker shafts, said straight jumper tube having an internal hydraulic passage providing hydraulic communication between the hydraulic fluid supply circuits of the second and third of the plurality of rocker shafts.

Applicants have still further developed an innovative system for actuating one or more engine valves comprising: a plurality of rocker shafts; a plurality of lost motion housings, each of said plurality of lost motion housings comprising a rocker shaft pedestal and being disposed about a respective one of the plurality of rocker shafts, each of said lost motion housings having a collar surrounding a respective one of the plurality of rocker shafts, a lower pedestal portion adapted to contact a cylinder head, an actuator piston bore, a control valve bore, and an internal hydraulic circuit extending from the actuator piston bore to the control valve bore; means for securing each of the plurality of lost motion housings in a fixed position relative to a respective one of the plurality of rocker shafts; a plurality of actuator piston assemblies, each disposed in a respective one of the actuator piston bores; a plurality of control valve assemblies, each disposed in a respective one of the control valve bores; a solenoid valve; a hydraulic fluid supply in hydraulic communication with the solenoid valve; a first external hydraulic fluid tube extending from the solenoid valve to a first one of the plurality of control valve assemblies; and a second external hydraulic fluid tube extending from the first one of the plurality of control valve assemblies to a second one of the plurality of control valve assemblies.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

In order to assist the understanding of this invention, reference will now be made to the appended drawings, in which like reference characters refer to like elements. The drawings are exemplary only, and should not be construed as limiting the invention.

DETAILED DESCRIPTION OF EMBODIMENTS OF THE INVENTION

Figure 1:
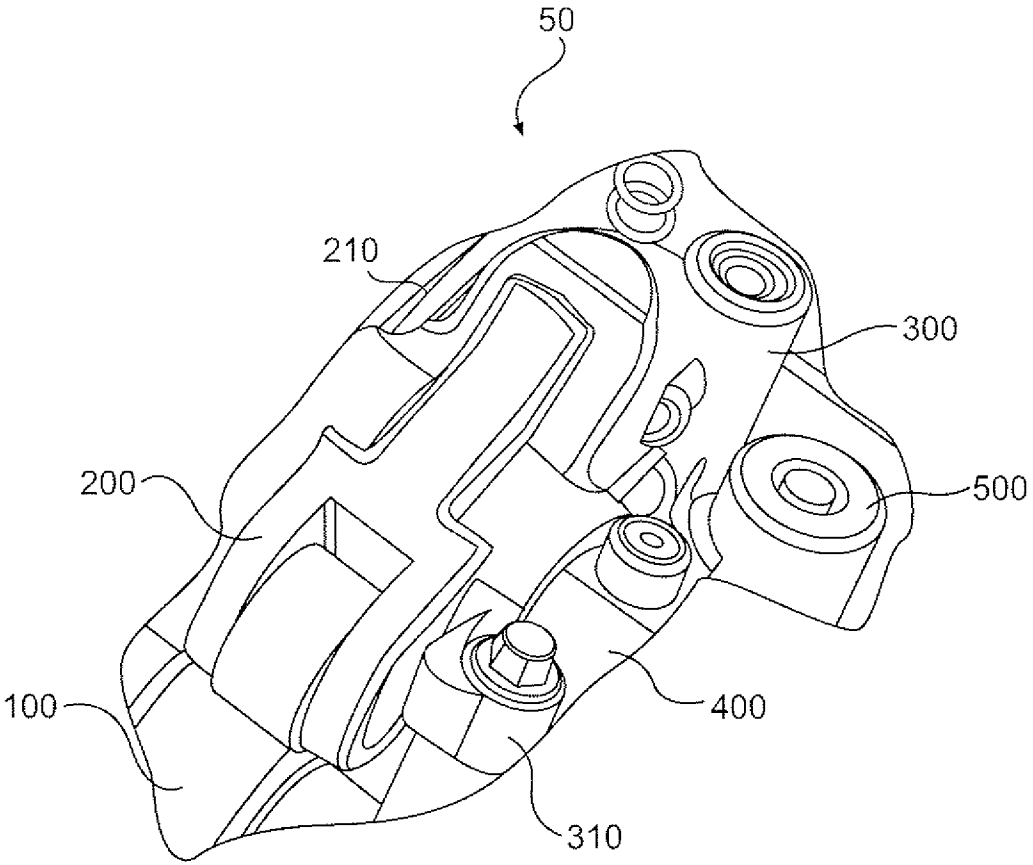
FIG. 1 is a pictorial view of an engine brake system having an articulated rocker arm and a rocker shaft mounted housing for master and slave pistons constructed in accordance with a first embodiment of the present invention and disposed in an internal combustion engine.

Reference will now be made in detail to a first embodiment of the present invention, an example of which is illustrated in the accompanying drawings. With reference to FIG. 1, a system 50 for actuating engine valves arranged in accordance with a first embodiment of the present invention is shown. FIGS. 2-9 show different views of the system shown in FIG. 1 and/or its components. The system 50 may include a cam 100, an articulated half rocker arm 200, a brake housing 300, a rocker shaft 400, and a solenoid valve 500. The rocker arm 200 may be biased away from (or alternatively towards) the cam 100 by a return spring 210 (see also FIG. 11). The brake housing may be secured in position by a anti-rotation bolt 310.

Figure 2:
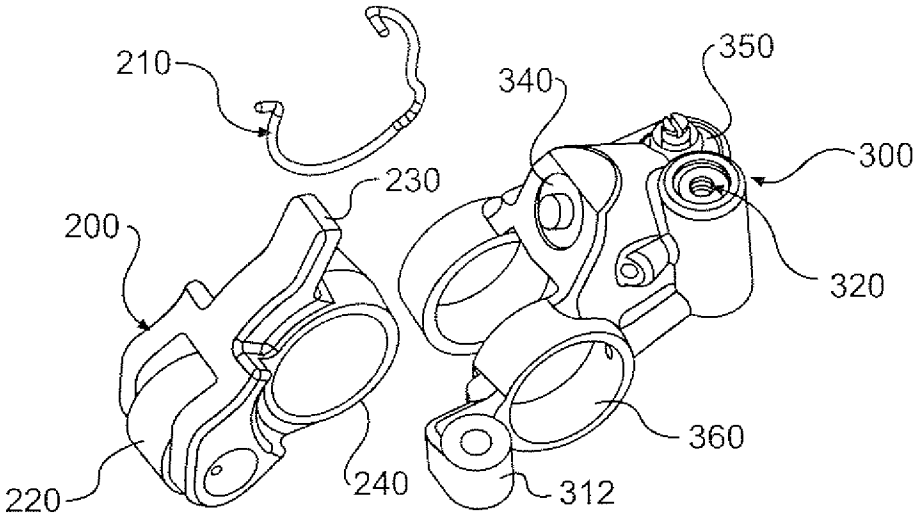
FIG. 2 is an overhead exploded pictorial view of an engine brake system having an articulated rocker arm, rocker shaft mounted housing, and a rocker arm return spring in accordance with the first embodiment of the present invention.
Figure 3:
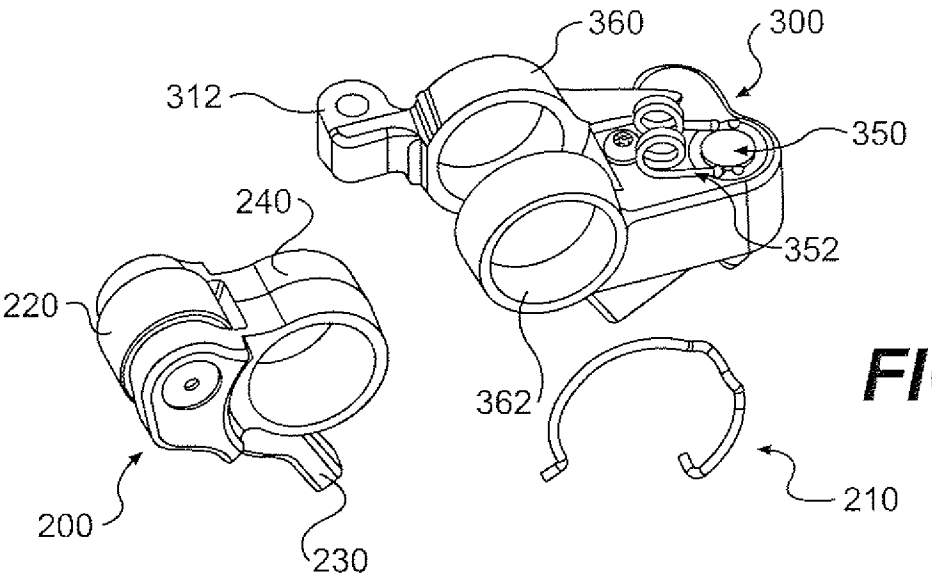
FIG. 3 is an overhead exploded pictorial view of the underside of the engine brake system shown in FIG. 2 as arranged in accordance with the first embodiment of the present invention.

With reference to FIGS. 2 and 3, the rocker arm 200 may further include a cam roller 220, a lug 230, and a central collar 240. The rocker arm return spring 210 may bias the rocker arm 200 towards the brake housing 300 such that the lug 230 contacts the master piston 340. The brake housing 300 may further include an anti-rotation bolt boss 312, a control valve 320, a master piston 340, a slave piston 350 and rocker shaft collars 360 and 362. A slave piston return spring 352 may bias the slave piston 350 up into a slave piston bore formed in the brake housing 300.

Figure 4:
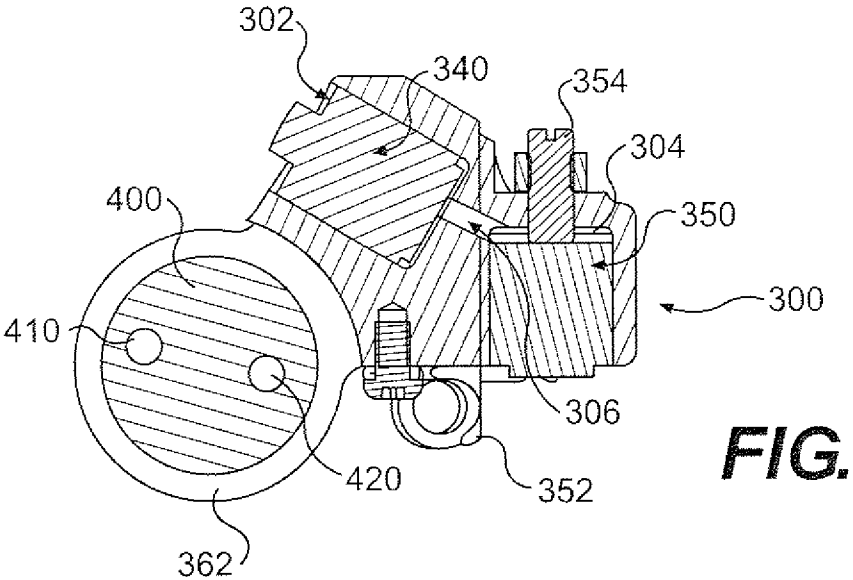
FIG. 4 is a cross-sectional side view of a rocker shaft mounted housing of FIGS. 2 and 3 which shows the master and slave pistons arranged in accordance with the first embodiment of the present invention.

With reference to FIG. 4, the rocker shaft collars 360 and 362 of the brake housing 300 may be mounted on the rocker shaft 400. The brake housing may be secured in a fixed position relative to the rocker shaft 400 by the anti-rotation bolt 310 (not shown). The brake housing 300 may include a master piston 340 slidably disposed in a master piston bore 302 and a slave piston 350 slidably disposed in a slave piston bore 304. A master-slave hydraulic fluid passage 306 may extend between the master piston bore 302 and the slave piston bore 304. The slave piston return spring 352 may bias the slave piston 350 upward and against a slave piston lash adjustment screw 354 which extends into the slave piston bore 304. The slave piston lash adjustment screw 354 may be locked into position by a nut 356 (see FIG. 6). The rocker shaft 400 may include a first hydraulic passage 410 adapted to provide lower pressure hydraulic fluid to the rocker arm 200 (not shown in FIG. 4) for lubrication purposes. The rocker shaft 400 may also include a second hydraulic passage 420, the purpose of which is explained in connection with FIG. 5.

Figure 5:
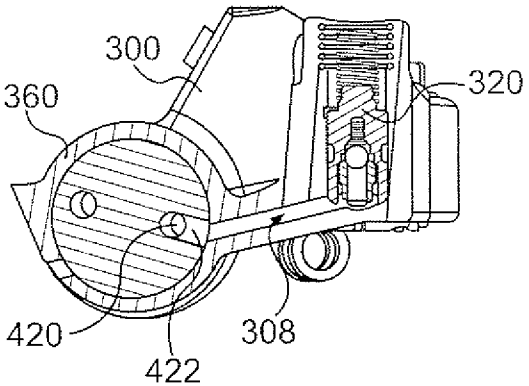
FIG. 5 is a second cross-sectional side view of the rocker shaft mounted housing of FIGS. 2 and 3 which shows the control valve in hydraulic communication with the rocker shaft and the master and slave pistons as arranged in accordance with the first embodiment of the present invention.

With reference to FIG. 5, adjacent to the slave piston 350 (shown in FIG. 4) the brake housing 300 may further include control valve 320. The control valve 320 may fill the master and slave bores with hydraulic fluid when low pressure hydraulic fluid is supplied to the lower portion of the control valve via a supply passage 308. A connection hydraulic passage 422 provided in the rocker shaft 400 may extend between the second hydraulic passage 420 and the supply passage 308 provided in the brake housing 300. As a result, hydraulic fluid may be supplied to the control valve, and the master and slave bores, by the selective supply of low pressure hydraulic fluid in the second hydraulic passage 420.

Figure 6:
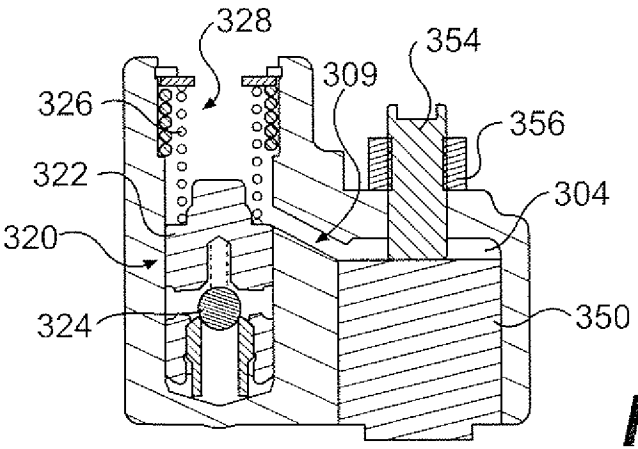
FIG. 6 is a cross-sectional front view of the rocker shaft mounted housing of FIGS. 2 and 3 showing the control valve and the slave piston as arranged in accordance with the first embodiment of the present invention.

A front cross-sectional view of the brake housing 300 is shown in FIG. 6. With reference to FIG. 6, the control valve 320 is shown in a "brake off" position during which the control valve body 322 is biased into its lower most position by the control valve spring 326. When the brake is turned on, hydraulic fluid from the second hydraulic passage 420 in the rocker shaft 400 (shown in FIG. 5) may be supplied to the lower portion of the control valve body 322. The supply of hydraulic fluid may cause the control valve body 322 to move upward until the annular opening provided in the mid-portion of the control valve body registers with the slave bore supply passage 309. The hydraulic fluid pressure applied to the lower portion of the control valve 320 may be sufficient to push the check valve 324 open so that hydraulic fluid flows into the slave piston bore 304 via the slave bore supply passage 309. With renewed reference to FIG. 4, the hydraulic fluid may further flow from the slave piston bore 304 through the master-slave hydraulic fluid passage 306 into the master piston bore 302. While the brake is in a "brake on" position, hydraulic fluid may be supplied freely to the master-slave piston circuit by the control valve 320, while the check valve 324 within the control valve prevents the reverse flow of fluid. As a result, the master-slave hydraulic circuit in the brake housing 300 may experience high hydraulic fluid pressures without substantial back flow of hydraulic fluid.

The brake may be returned to the "brake off" position shown in FIG. 6 by reducing the hydraulic fluid pressure, preferably by evacuating the hydraulic fluid, applied to the lower portion of the control valve 320. When this happens, the control valve body 322 may slide downward until the slave bore supply passage 309 is exposed to the control valve bore 328, thereby allowing the hydraulic fluid in the master-slave hydraulic circuit to escape. The selective supply of hydraulic fluid to the control valve 320 may be controlled by the solenoid 500 shown in FIG. 1. Alternative placements of the solenoid 500 are considered within the scope of the present invention.

Figure 7:
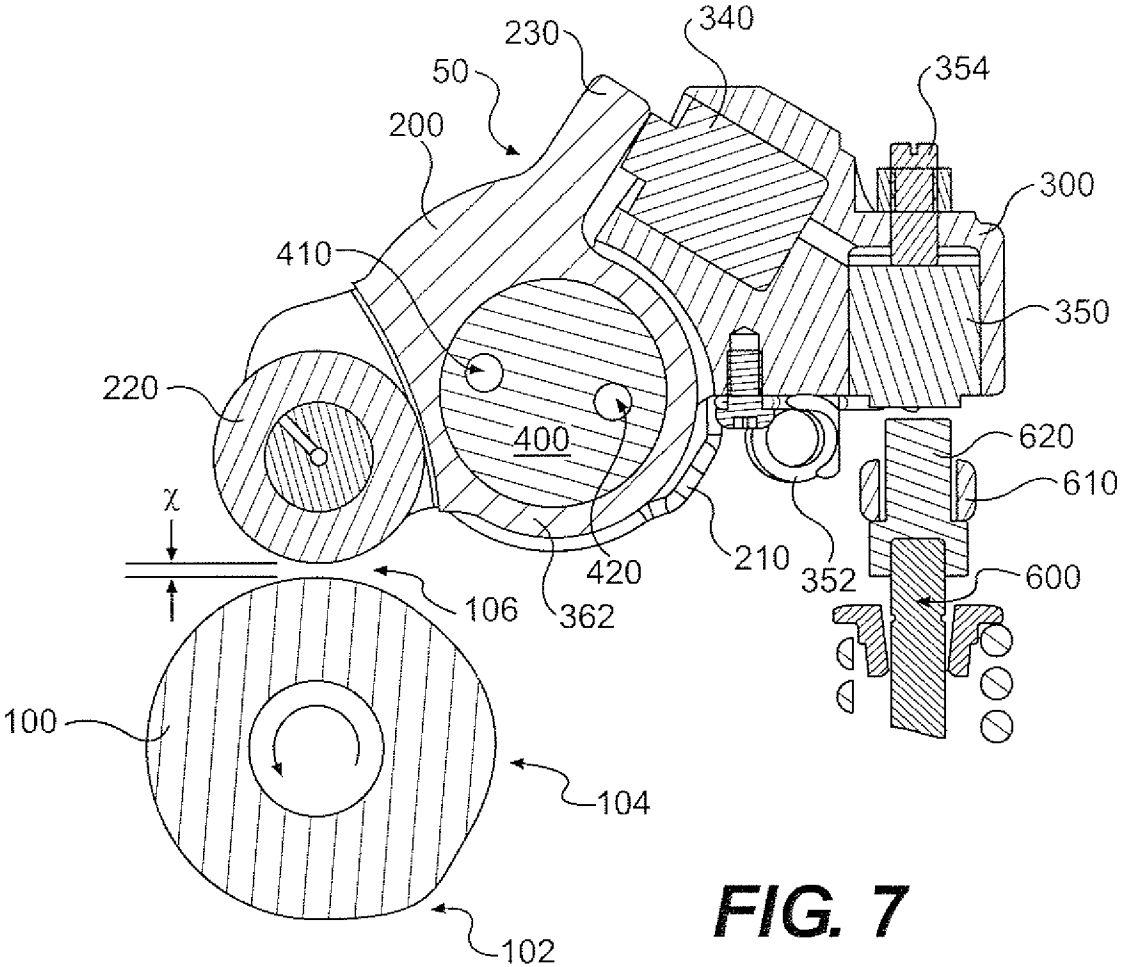
FIG. 7 is a cross-sectional side view of the engine brake system of FIGS. 2 and 3 showing the articulated rocker arm, rocker shaft mounted housing, and cam lobe as arranged in accordance with the first embodiment of the present invention when the engine brake system is turned off.

The arrangement of the various elements of the system 50 when the engine brake is in a "brake off" position is shown in FIG. 7. With reference to FIG. 7, the cam lobe 100 is illustrated as having two valve actuation bumps. A first cam bump 102 may provide a compression-release valve actuation event and a second cam bump 104 may provide a brake gas recirculation (BGR) valve actuation event. Alternative cam lobes with more, less, or different cam bumps are contemplated as being within the scope of the present invention.

The system 50 is positioned adjacent to an engine valve, such as an exhaust valve 600. The system 50 may actuate the exhaust valve 600 through a sliding pin 620 that extends through a valve bridge 610. Use of such a sliding pin and valve bridge arrangement may permit a separate valve actuation system to actuate multiple engine valves for positive power operation and a single engine valve 600 for non-positive power operation, such as engine braking.

With continued reference to FIG. 7, when the brake is in a "brake off" position, hydraulic fluid pressure in the second hydraulic passage 420 is reduced or eliminated. As a result, there is no hydraulic fluid pressure maintained in the master-slave hydraulic fluid circuit connecting the master piston 340 and the slave piston 350. Accordingly, the bias of the slave piston return spring 352 may be sufficient to push the slave piston 350 all the way into the slave piston bore against the lash adjustment screw 354. Furthermore, the bias of the rocker arm return spring 210 may be sufficient to rotate the rocker arm 200 such that the rocker arm lug 230 pushes the master piston 340 all the way into the master piston bore. The rotation of the rocker arm 200 in this manner may create a lash space 106 between the cam roller 220 and the cam lobe 100. The lash space 106 may be designed to have a magnitude x that is as great or greater than the height of the cam bumps 102 and 104. Thus, when the system 50 is in a "brake off" position, the cam bumps 102 and 104 may not have any effect on the rocker arm 200 or the master and slave pistons 340 and 350.

Figure 8:
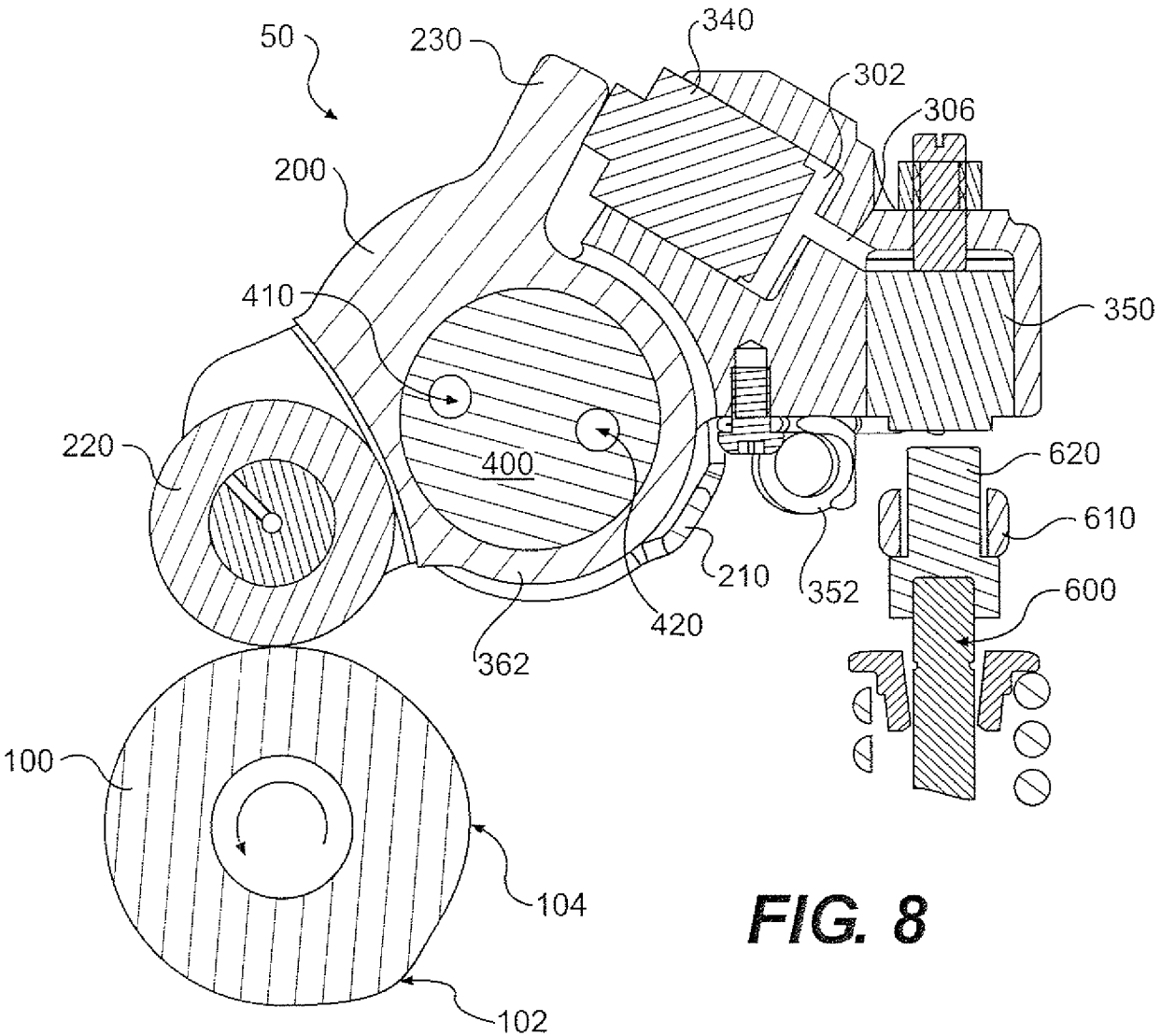
FIG. 8 is a cross-sectional side view of the engine brake system of FIGS. 2 and 3 showing the articulated rocker arm, rocker shaft mounted housing, and cam lobe as arranged in accordance with the first embodiment of the present invention when the engine brake system is turned on and rocker arm is contacting the cam base circle.

The arrangement of the various elements of the system 50 when the engine brake is in a "brake on" position is shown in FIG. 8. With reference to FIG. 8, when the brake is turned "on," hydraulic fluid is supplied through the second hydraulic passage 420 to the control valve 320 (not shown) and the master-piston hydraulic circuit in the brake housing. When the cam lobe 100 is at base circle, as shown in FIG. 8, the hydraulic fluid pressure in the master-slave hydraulic fluid circuit connecting the master piston 340 and the slave piston 350 may push the master piston 340 out of its bore, overcoming the bias of the rocker arm return spring 210 and rotating the rocker arm 200 backwards until the cam roller 220 contacts the cam lobe 100. As a result, the lash space 106 may be eliminated. At this time (cam lobe at base circle), the hydraulic pressure in the master-slave hydraulic circuit is not sufficient, however, overcome the bias of the slave piston return spring 352 and push the slave piston 350 out of the slave piston bore.

Figure 9:
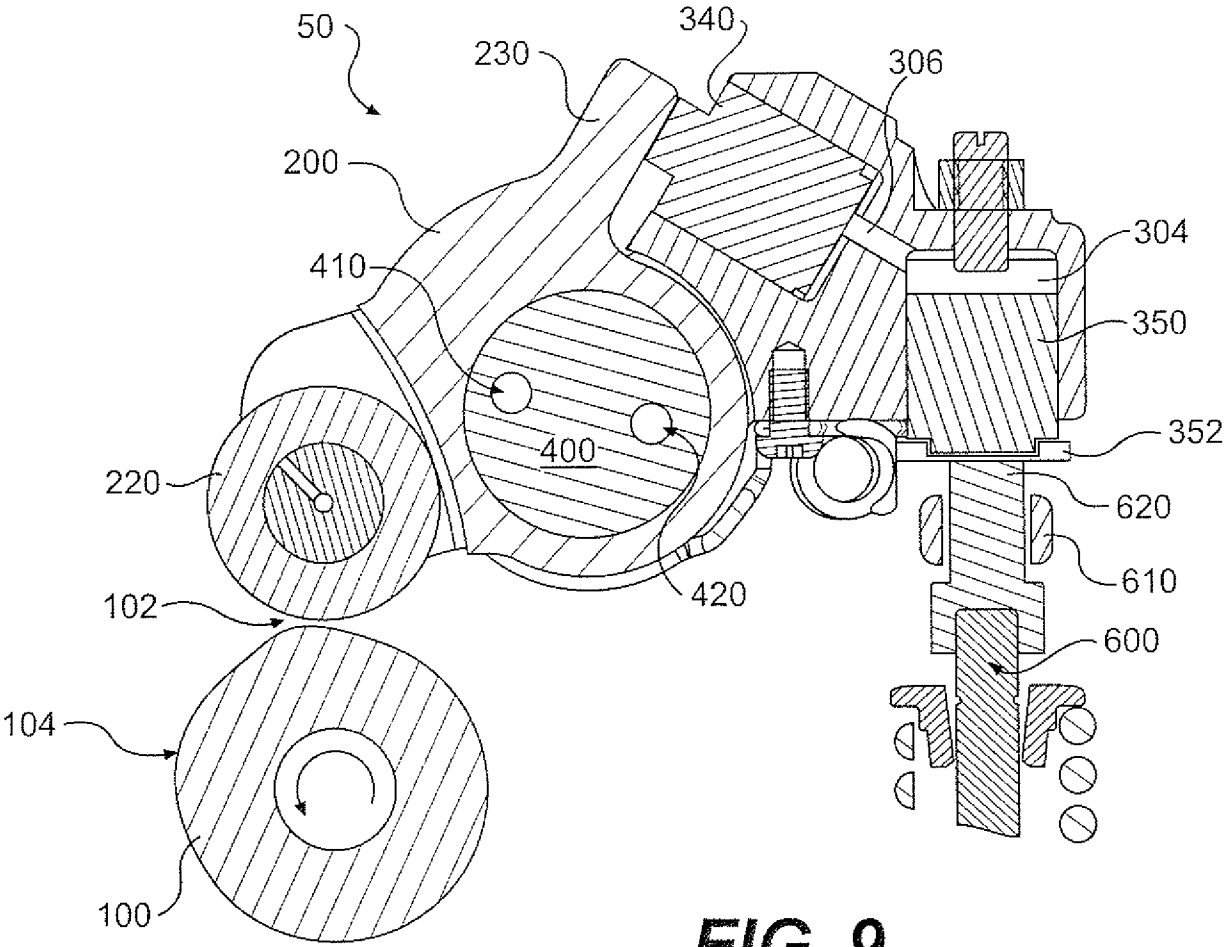
FIG. 9 is a cross-sectional side view of the engine brake system of FIGS. 2 and 3 showing the articulated rocker arm, rocker shaft mounted housing, and cam lobe as arranged in accordance with the first embodiment of the present invention when the engine brake system is turned on and the rocker arm is contacting the cam compression-release bump.

With reference to FIG. 9, when the cam roller 220 encounters the cam bump 102 (and 104), the rocker arm 200 is rotated slightly clockwise. Rotation of the rocker arm 200 may push the master piston 340 into the master piston bore thereby displacing hydraulic fluid through the master-slave hydraulic fluid passage 306 and into the slave piston bore. As a result, the bias of the slave piston return spring 352 is overcome and the slave piston 350 may be displaced downward against the sliding pin 620, which in turn, may actuate the exhaust valve 600 for a compression-release event or some alternative valve actuation event.

Figure 10:
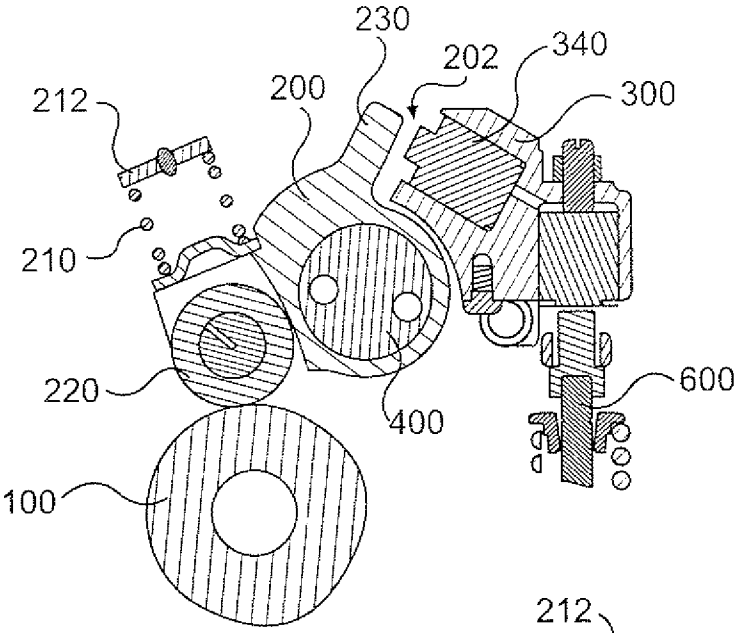
FIG. 10 is a cross-sectional side view of an engine brake system showing the articulated rocker arm, rocker shaft mounted housing, and cam lobe as arranged in accordance with a second embodiment of the present invention when the engine brake system is turned off.
Figure 11:
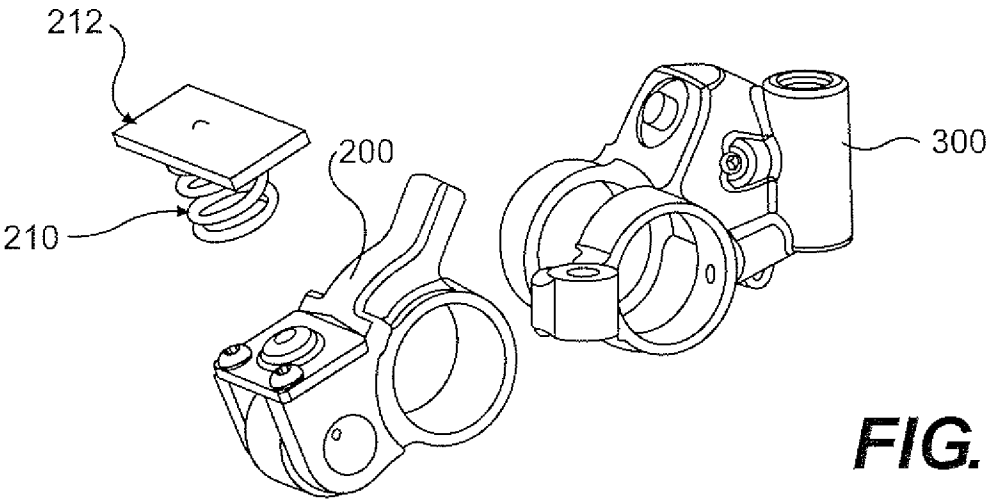
FIG. 11 is an exploded pictorial view of an engine brake system having an articulated rocker arm, rocker shaft mounted housing, and a rocker arm return spring in accordance with the second embodiment of the present invention.

An alternative embodiment of the present invention is shown in FIGS. 10 and 11. With reference to FIGS. 10 and 11, the rocker arm return spring 210 may be provided in the form of a coil spring as opposed to a mouse-trap type spring. Furthermore, the return spring 210 may extend between an overhead element 212 and a rear portion of the rocker arm 200 such that the rocker arm is biased into continual contact with the cam lobe 100 when the system is in a "brake off" position, as shown in FIG. 10. As a result, instead of creating a lash space between the cam lobe 100 and the cam roller 220 when the brake is off, a lash space 202 may be created between the rocker arm lug 230 and the master piston 340.

Figure 12:
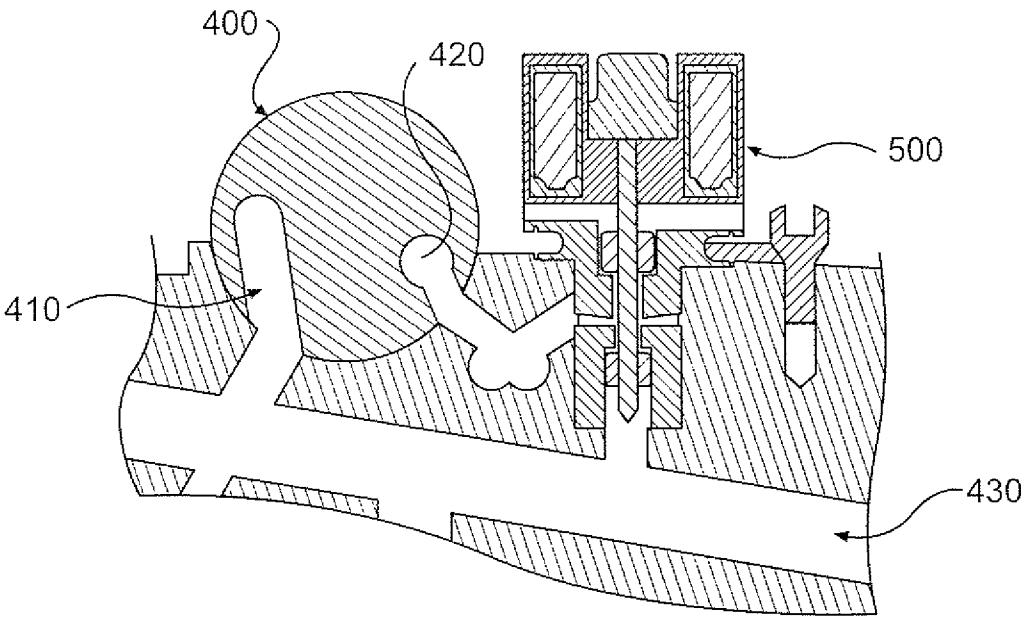
FIG. 12 is a cross-sectional side view of the engine brake system of FIGS. 2 and 3 showing the oil passage schematic between the engine oil supply passage, solenoid valve and rocker shaft.

With reference to FIG. 12, the communication between an engine oil supply passage 430 and the first and second hydraulic passages 410 and 420 are shown. The solenoid 500 may be disposed between the engine oil supply passage 430 and the rocker shaft 400.

Figure 13:
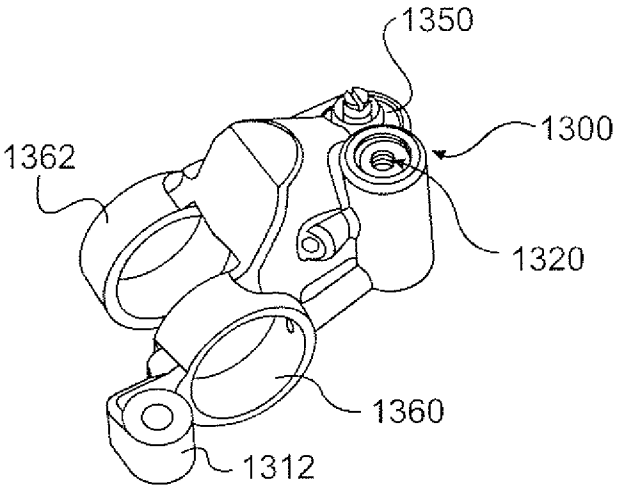
FIG. 13 is an overhead pictorial view of a valve actuation system that may be used for bleeder braking in particular, having a rocker shaft mounted housing in accordance with a second embodiment of the present invention.
Figure 14:
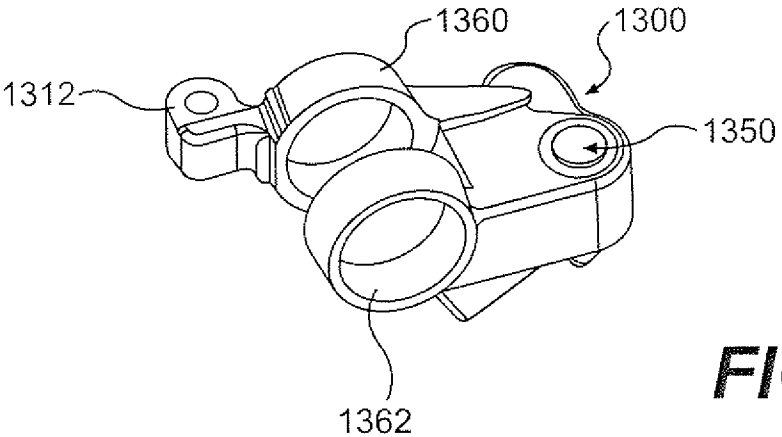
FIG. 14 is a pictorial view of the underside of the valve actuation system shown in FIG. 13 as arranged in accordance with the second embodiment of the present invention.

With reference to FIGS. 13 and 14, in a second embodiment of the present invention, the rocker arm and master piston may be eliminated. The valve actuation system housing 1300 may include an anti-rotation bolt boss 1312, a control valve 1320, an actuator piston 1350 and rocker shaft collars 1360 and 1362. The rocker shaft collars may surround the rocker shaft providing a means for securely fixing the housing 1300 in a fixed and compact position relative to the engine valves to be actuated.

Figure 15:
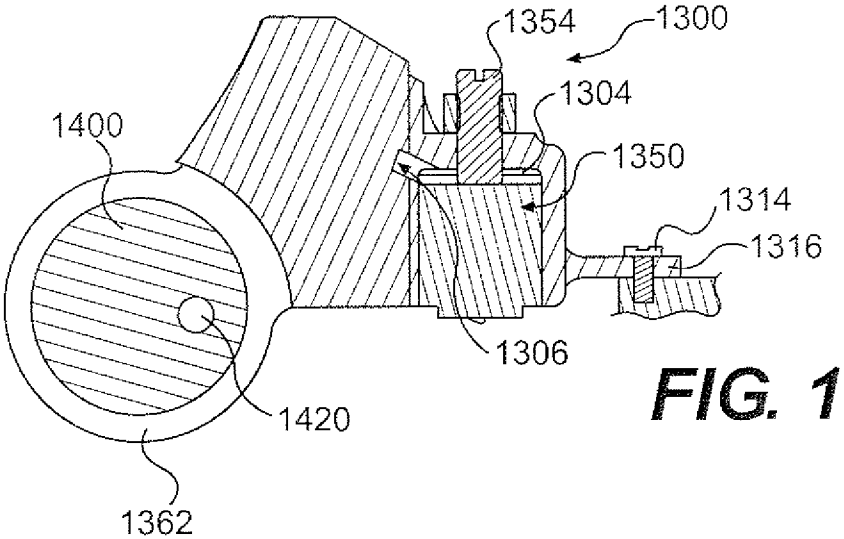
FIG. 15 is a cross-sectional side view of a rocker shaft mounted housing of FIGS. 13 and 14 which shows an alternative or additional flange for securing the rocker shaft mounted housing in a fixed position in accordance with an alternative embodiment of the present invention.

With reference to FIG. 15, the rocker shaft collars 1360 and 1362 of the housing 1300 may be mounted on the rocker shaft 1400. The housing may be secured in a fixed position relative to the rocker shaft 1400 by a first anti-rotation bolt 1310 (not shown) that extends through the anti-rotation bolt boss 1312 and/or by a second anti-rotation bolt 1314 that extends through an anti-rotation flange 1316. The anti-rotation boss 1312 may be provided distal from the actuator piston 1350 and the anti-rotation flange 1316 may be provided proximal to the actuator piston. The housing 1300 may include an actuator piston 1350 slidably disposed in an actuator piston bore 1304. An internal hydraulic circuit may include passage 1306 and passage 1308 (shown in FIG. 16). An actuator piston lash adjustment screw 1354 may extend into the actuator piston bore 1304 and provide an upper stop against which the actuator piston 1350 may seat. The rocker shaft 1400 may include a hydraulic fluid supply passage 1420, the purpose of which is explained in connection with FIG. 16.

Figure 16:
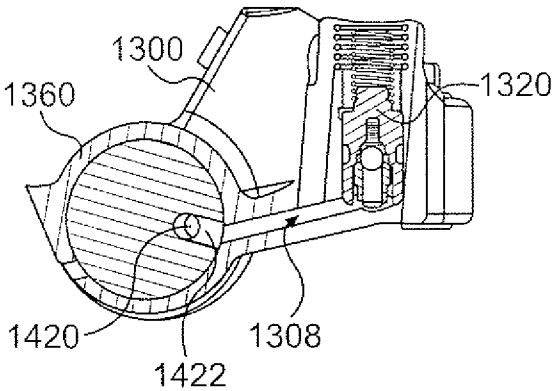
FIG. 16 is a second cross-sectional side view of the rocker shaft mounted housing of FIGS. 13 and 14 which shows the control valve in hydraulic communication with the rocker shaft and the actuator piston as arranged in accordance with the second embodiment of the present invention.

With reference to FIG. 16, adjacent to the actuator piston 1350 (shown in FIG. 15) the housing 1300 may further include a control valve 1320. The control valve 1320 may fill the passage 1306 of the internal hydraulic circuit with hydraulic fluid when low pressure hydraulic fluid is supplied to the lower portion of the control valve via a passage 1308 of the internal hydraulic circuit. A connection hydraulic passage 1422 provided in the rocker shaft 1400 may extend between the hydraulic fluid supply passage 1420 and the passage 1308 provided in the housing 1300. As a result, hydraulic fluid may be supplied to the control valve and the actuator piston bores by the selective supply of low pressure hydraulic fluid in the hydraulic fluid supply passage 1420.

Figure 17:
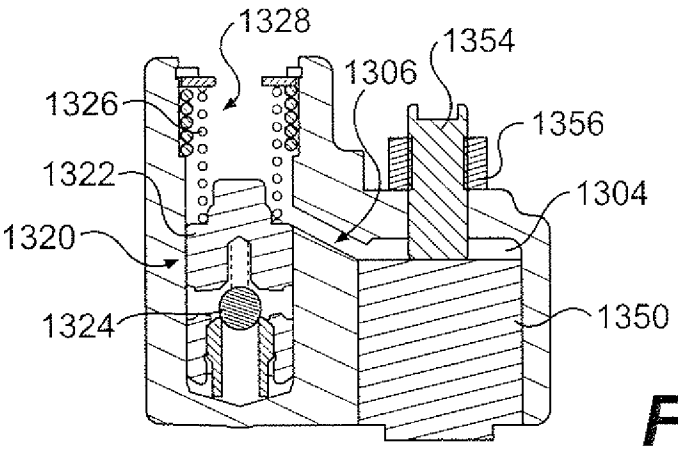
FIG. 17 is a cross-sectional front view of the rocker shaft mounted housing of FIGS. 13 and 14 showing the control valve and the actuator piston as arranged in accordance with the second embodiment of the present invention.

A front cross-sectional view of the system is shown in FIG. 17. With reference to FIG. 17, the control valve 1320 is shown in a "actuator off" position during which the control valve body 1322 is biased into its lower most position by the control valve spring 1326. When the system is turned on, hydraulic fluid from the hydraulic fluid supply passage 1420 in the rocker shaft 1400 (shown in FIG. 16) may be supplied to the lower portion of the control valve body 1322. The supply of hydraulic fluid may cause the control valve body 1322 to move upward until the annular opening provided in the mid-portion of the control valve body registers with the passage 1306. The hydraulic fluid pressure applied to the lower portion of the control valve 1320 may be sufficient to push the check valve 1324 open so that hydraulic fluid flows into the actuator piston bore 1304 via the passage 1306. While the system is in an "actuator on" position, hydraulic fluid may be supplied freely to the internal hydraulic circuit by the control valve 1320, while the check valve 1324 within the control valve prevents the reverse flow of fluid. As a result, the internal hydraulic circuit in the housing 1300 may experience high hydraulic fluid pressures without substantial back flow of hydraulic fluid.

The system may be returned to the "actuator off" position shown in FIG. 17 by reducing the hydraulic fluid pressure in the hydraulic fluid supply passage 1420, and preferably by evacuating the hydraulic fluid applied to the lower portion of the control valve 1320. When this happens, the control valve body 1322 may slide downward until the passage 1306 is exposed to the control valve bore 1328, thereby allowing the hydraulic fluid in the internal hydraulic circuit to escape. The selective supply of hydraulic fluid to the control valve 1320 may be controlled by the solenoid 1500 shown in FIG. 20. Alternative placements of the solenoid 1500 are considered within the scope of the present invention.

Figure 18:
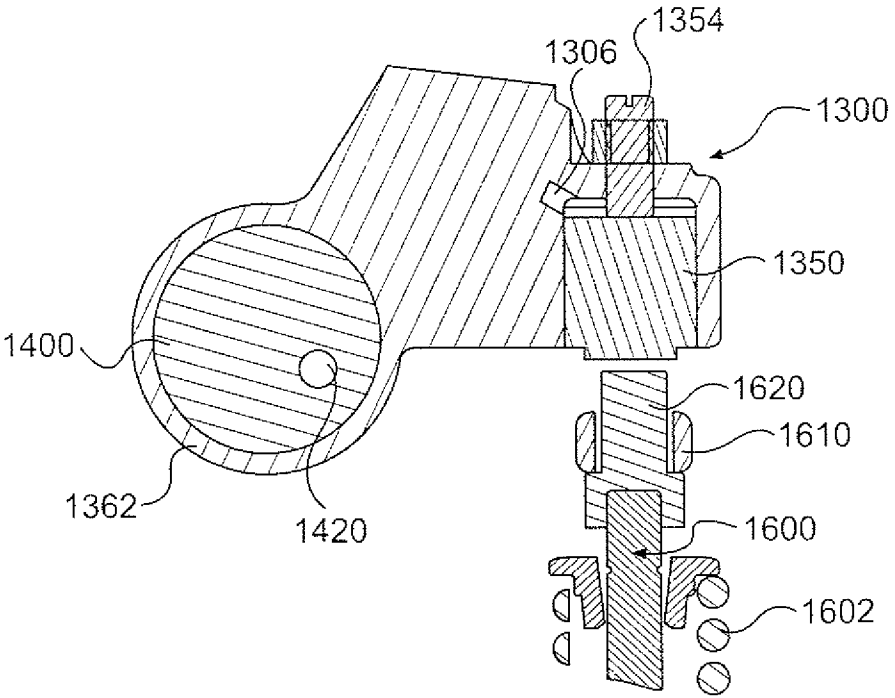
FIG. 18 is a cross-sectional side view of the valve actuation system of FIGS. 13 and 14 showing the rocker shaft mounted housing and actuator piston as arranged in accordance with the second embodiment of the present invention when the actuator piston is separated by a lash space from the sliding pin/engine valve.

The arrangement of the various elements of the system when the engine valve actuator is in an "actuator off" position is shown in FIG. 18. With reference to FIG. 18, the system is positioned adjacent to an engine valve, such as an exhaust valve 1600. The system may actuate the exhaust valve 1600 through a sliding pin 1620 that extends through a valve bridge 1610. Use of such a sliding pin and valve bridge arrangement may permit a separate valve actuation system to actuate multiple engine valves for positive power operation and a single engine valve 1600 for non-positive power operation, such as engine braking. With continued reference to FIG. 18, when the system is in an "actuator off" position, hydraulic fluid pressure in the hydraulic fluid supply passage 1420 is reduced or eliminated. As a result, there is no hydraulic fluid pressure maintained in the internal hydraulic fluid circuit connected to the actuator piston 1350. As a result, the actuator piston 1350 may rest against but not actuate the sliding pin 1620. Thus, when the system is in an "actuator off" position, the actuator piston may not provide any valve actuation motion to the engine valve.

Figure 19:
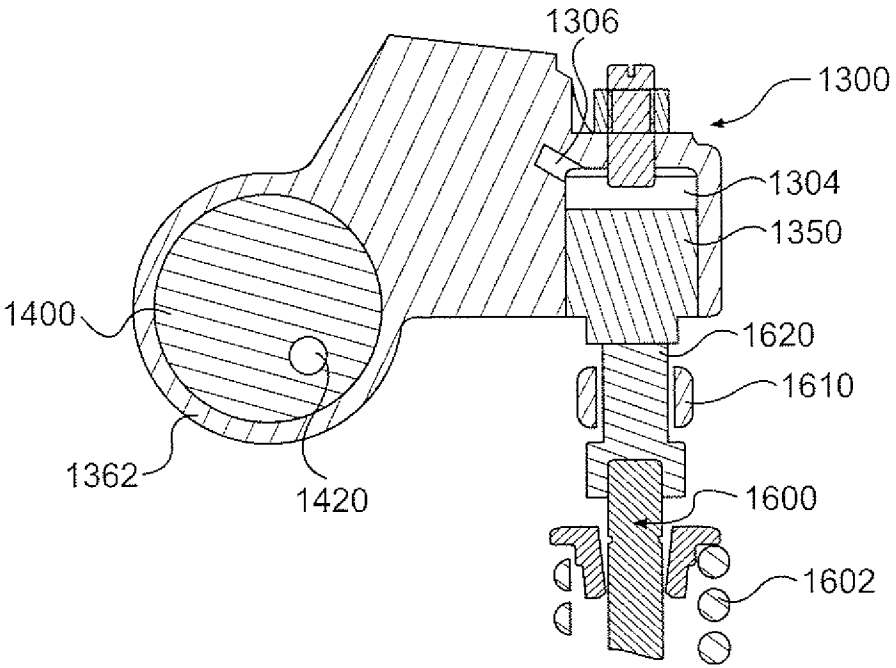
FIG. 19 is a cross-sectional side view of the valve actuation system of FIGS. 13 and 14 showing the rocker shaft mounted housing and actuator piston as arranged in accordance with the second embodiment of the present invention when the system is turned on and the actuator piston has actuated the engine valve.

The arrangement of the various elements of the system when it is in an "actuator on" position is shown in FIG. 19. With reference to FIG. 19, when the system is turned "on," hydraulic fluid is supplied through the hydraulic passage 1420 to the control valve 1320 (not shown). Hydraulic fluid pressure in the passage 1306 may push the actuator piston 1350 out of its bore so that if it is not already, it does contact the sliding pin 1620. At this time the hydraulic pressure in the internal hydraulic circuit may not be sufficient, however, to overcome the bias of the engine valve 1600 spring 1602. When the valve bridge 1610 is moved downward for main exhaust valve actuation event, for example, the low pressure hydraulic fluid in the actuator piston bore 1304 may push the actuator piston 1350 and the sliding pin 1620 downward so that they follow the valve bridge until the actuator piston reaches its maximum downward displacement. As the valve bridge 1610 returns upward at the conclusion of the main exhaust event, the hydraulic fluid in the passage 1306 may become highly pressurized so that the actuator piston 1350 holds the exhaust valve 1600 open for an engine valve event, such as a bleeder braking event. The actuator piston 1350 may continue to hold the exhaust valve 1600 open until the control valve 1320 releases the hydraulic fluid pressure in the passage 1306. It is appreciated that the valve actuation system may be used for intake and auxiliary engine valve actuation in addition to exhaust valve actuation.

Figure 20:
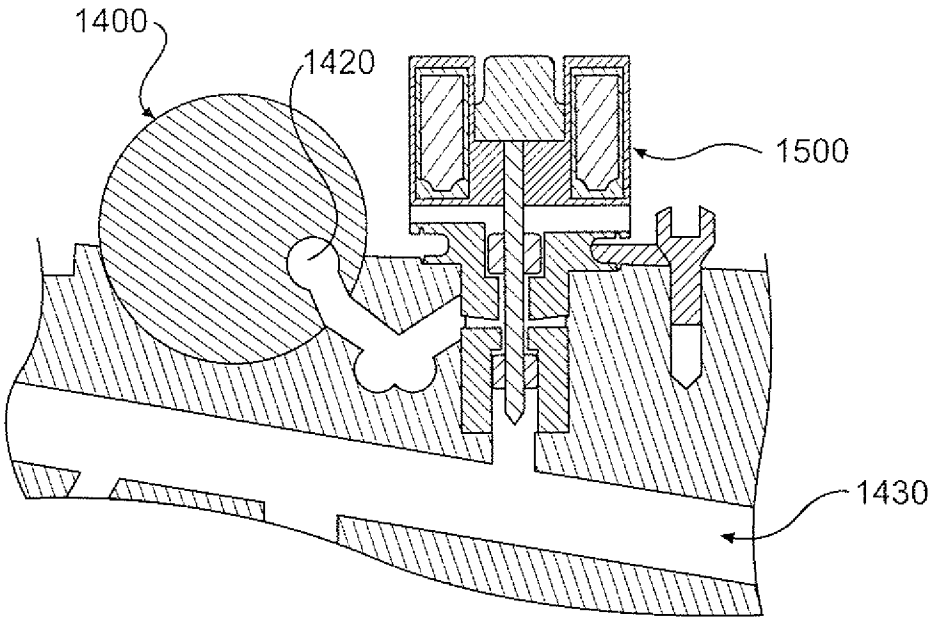
FIG. 20 is a cross-sectional side view of the valve actuation system of FIGS. 13 and 14 illustrating control of hydraulic fluid supply by a solenoid valve.

With reference to FIG. 20, the communication between an engine hydraulic fluid supply passage 1430 and the hydraulic fluid supply passage 1420 is shown. The solenoid valve 1500 may be disposed between the engine hydraulic fluid supply passage 1430 and the hydraulic fluid supply passage 1420 in the rocker shaft 1400. The solenoid valve 1500 may be provided adjacent to the rocker shaft mounted engine brake system on, for example, a rocker shaft pedestal.

Figure 21:
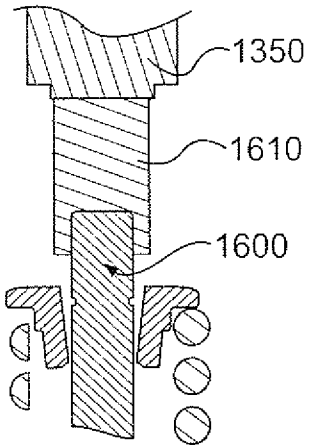
FIG. 21 is a cross-sectional side view of a valve bridge disposed between an actuator piston and an engine valve in accordance with an alternative embodiment of the present invention.

With reference to FIG. 21, in alternative embodiments of the system shown in FIGS. 13-20 and 22-28, the actuator piston 1350 may act directly on an engine valve 1600 or on an engine valve bridge 1610 instead of acting on a sliding pin.

Figure 23:
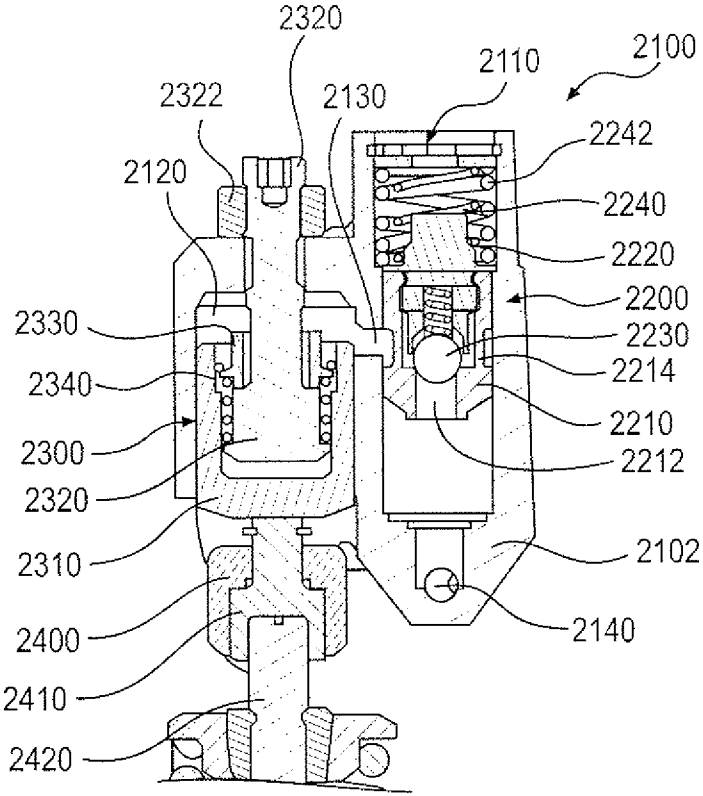
FIG. 23 is a cross-sectional view of a lost motion housing incorporated into a rocker shaft pedestal for actuating one or more engine valves shown in FIG. 22 after being supplied with hydraulic fluid sufficient to provided engine valve actuation in accordance with an alternative embodiment of the present invention.
Figure 22:
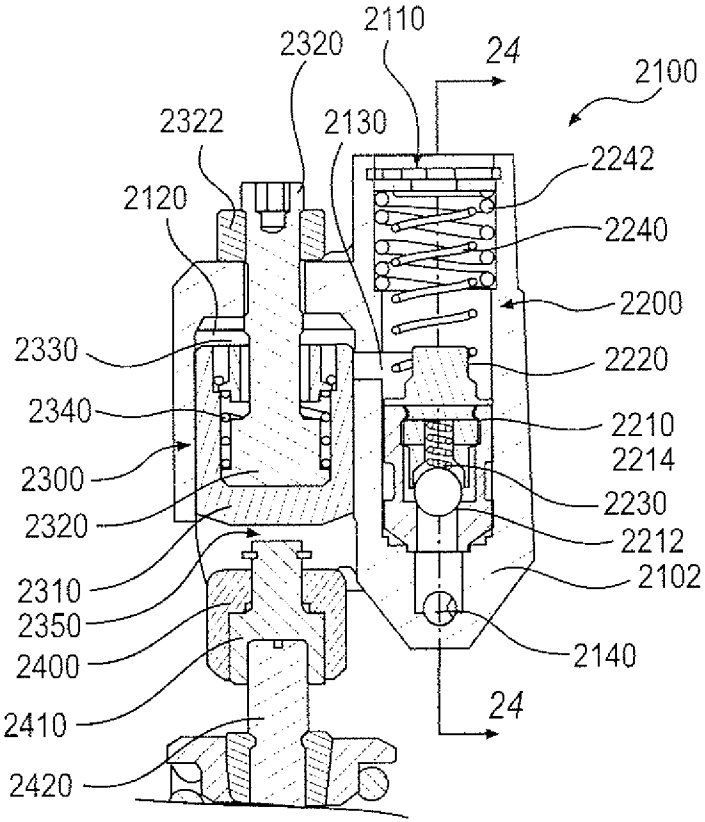
FIG. 22 is a cross-sectional view of a lost motion housing incorporated into a rocker shaft pedestal for actuating one or more engine valves prior to being supplied with hydraulic fluid sufficient to provided engine valve actuation in accordance with an alternative embodiment of the present invention.
Figure 24:
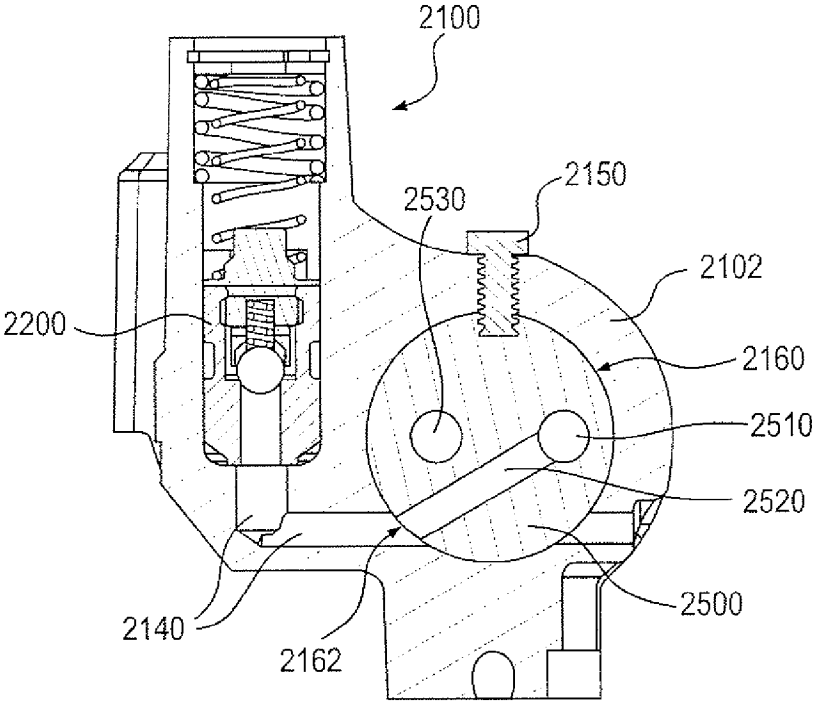
FIG. 24 is a cross-sectional view of the lost motion housing of the system shown in FIGS. 22 and 23 taken along cut line 24-24 in FIG. 22.

With reference to FIGS. 22-24, an alternative embodiment of a system for actuating one or more engine valves is shown.

The system may include a rocker shaft pedestal assembly 2100 which incorporates a lost motion housing 2102, a control valve assembly 2200 and an actuator piston assembly 2300. The pedestal assembly 2100 may reduce the overall weight and space required for inclusion of a lost motion system in the engine by comprising both (i) a rocker shaft pedestal used to support a rocker shaft and (ii) a lost motion system used to actuate an engine valve 2400, such as an exhaust valve or an intake valve. The pedestal assembly 2100 may be particularly useful for actuating an exhaust valve for engine braking, such as bleeder braking or partial bleeder braking.

The lost motion housing 2102 may include a control valve bore 2110, an actuator piston bore 2120, and a rocker shaft bore 2160. The control valve bore 2110 may receive the control valve assembly 2200, the actuator piston bore 2120 may receive the actuator piston assembly 2300, and the rocker shaft bore 2160 may receive the rocker shaft 2500. An internal hydraulic fluid passage 2130 may extend through the lost motion housing 2102 from the control valve bore 2110 to the actuator piston bore 2120. A lost motion housing supply passage 2140 may extend through the lost motion housing 2102 from the control valve bore 2110 to a port 2162 provided on the rocker shaft bore 2160.

With particular reference to FIG. 24, the lost motion housing 2102 may be disposed about the rocker shaft 2500 such that a collar surrounds the rocker shaft and the lower pedestal portion of the lost motion housing rests on and contacts the cylinder head (not shown). The rocker shaft 2500 may include a first fluid supply passage 2510 extending along the longitudinal axis of the rocker shaft and a second fluid supply passage 2520 extending from the first fluid supply passage to a port provided on the outer surface of the rocker shaft. The first and second fluid supply passages 2510 and 2520 may collectively comprise a hydraulic fluid supply circuit 2510/2520 for the pedestal assembly 2100. The port on the outer surface of the rocker shaft and the port 2162 provided on the rocker shaft bore 2160 may register so that hydraulic fluid may flow between the two ports. The rocker shaft 2500 may also include a lubrication fluid supply passage 2530. An anti-rotation pin or one or more bolts 2150 may extend through the lost motion housing 2102 into a recess formed in the rocker shaft 2500 to secure the lost motion housing in a fixed position relative to the rocker shaft. One or more bolts (not shown) may also or alternatively secure the lost motion housing 2102 in a fixed position relative to the rocker shaft 2500 by extending through the lost motion housing into the cylinder head.

With renewed reference to FIGS. 22-24, the control valve assembly 2200 may include a control valve outer body 2210 and a control valve inner body 2220 which is press fit, screwed into, or otherwise connected to the control valve outer body. The control valve inner body may include an internal recess for receiving a spring biased check valve 2230. The control valve outer body 2210 may include a lower passage 2212 extending from the lost motion housing supply passage 2140 to the check valve 2230, and a lateral passage 2214 extending from the check valve 2230 to internal hydraulic fluid passage 2130 when fluid is supplied to the control valve (as shown in FIG. 23). The control valve outer body 2210 may be biased into the control valve bore 2110 by first and second control valve springs 2240 and 2242.

The actuator piston assembly 2300 may be auto-lash setting and include a lash screw 2320 extending through the lost motion housing 2102 into the actuator piston bore 2120. The lash screw 2320 may include an enlarged lower portion which is received within the hollow interior portion of the actuator piston 2310. The lash screw 2320 may be secured in place by a lash screw nut 2322. An actuator collar 2330 may be connected to the actuator piston 2310 in the hollow interior of the actuator piston 2310 by a ring shaped element. The actuator collar may have a central opening surrounding the lash screw 2320 which fit loosely enough about the lash screw to permit hydraulic fluid to freely flow past the collar into the hollow interior of the actuator piston 2310. An actuator piston spring 2340 may be provided between the actuator collar 2330 and the enlarged lower portion of the lash screw 2320 in the hollow interior of the actuator piston 2310. The lash screw 2320 may be adjusted vertically to set a lash space 2350 (FIG. 22) between the lower surface of the actuator piston 2310 and a valve bridge pin 2410.

Figure 25:
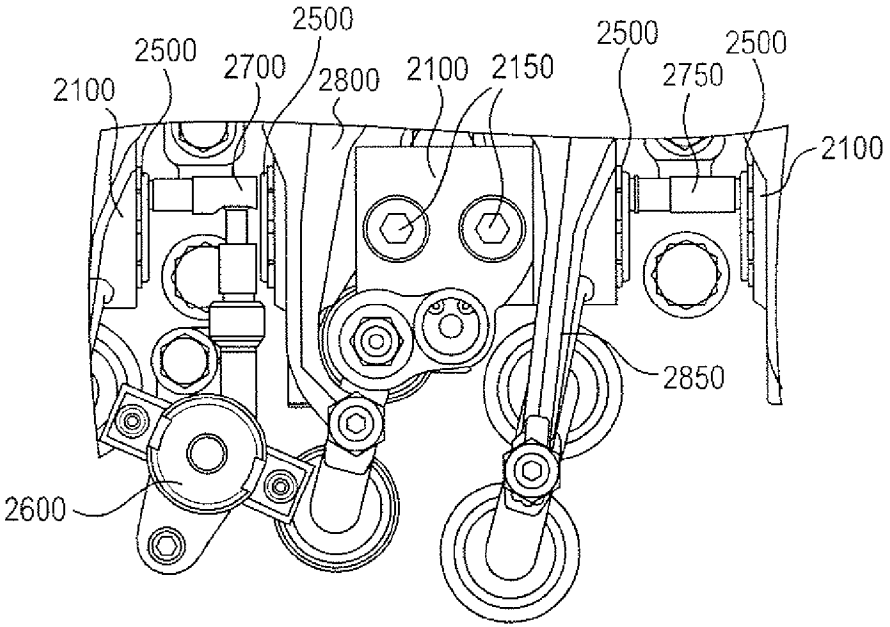
FIG. 25 is an overhead pictorial view of an engine valve actuation system having a plurality of lost motion housings of the type shown in FIGS. 22-24.

With reference to FIG. 25, the plurality of pedestal assemblies 2100 shown may be provided with hydraulic fluid under the control of a solenoid valve assembly 2600. External hydraulic fluid tubing may be used to provide hydraulic fluid from the solenoid valve assembly 2600 to the pedestal assemblies 2100. In the embodiment shown in FIG. 25, the external hydraulic fluid tubing may comprise a T-jumper tube 2700 and one or more straight jumper tubes 2750. The T-jumper tube 2700 may provide hydraulic fluid communication between the solenoid valve assembly 2600 and two adjacent rocker shafts 2500. The straight jumper tubes 2750 may provide hydraulic fluid communication between any other pairs of adjacent rocker shafts 2500. While only one straight jumper tube 2750 is shown in FIG. 25, it is appreciated that additional straight jumper tubes may be used to connect a succession of additional rocker shafts that may be used in the overall system. FIG. 25 also illustrates the arrangement of an exhaust valve rocker arm 2800 and an intake rocker arm 2850 relative to the pedestal assembly 2100. Securing means, or bolts, 2150, are also shown in FIG. 25.

Figure 26:
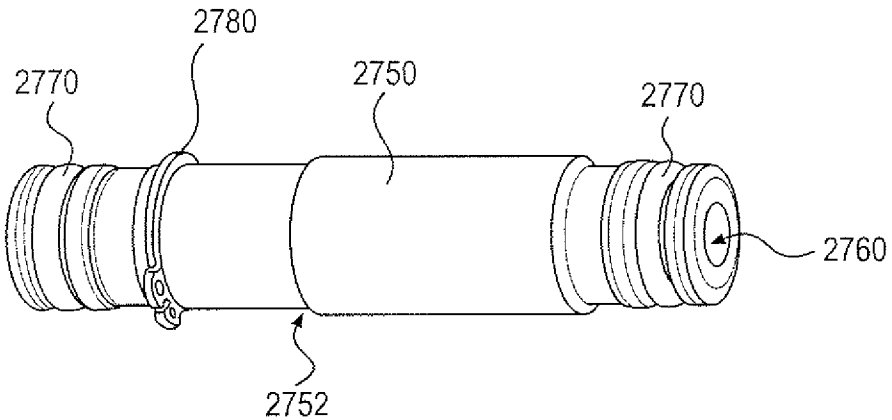
FIG. 26 is a pictorial view of a straight jumper tube used to connect rocker shafts used in the system for actuating one or more engine valves shown in FIGS. 22-25.

FIG. 26 is a pictorial view of a straight jumper tube 2750. The straight jumper tube 2750 may include an internal hydraulic passage 2760, a central shoulder 2752, hydraulic seals 2770, and a clamping ring 2780. The straight jumper tube 2750 may be installed by sliding the smaller diameter end (left end) into the first fluid supply passage 2510 (FIG. 24) of a rocker shaft 2500 so that the clamping ring 2780 is pressed into the central shoulder 2752. The rocker shaft 2500 may then be installed in the engine. Thereafter, the straight jumper tube 2750 may be retracted out of the first fluid supply passage 2510 until the opposite end of the tube enters the first fluid supply passage of an adjacent rocker shaft so that the seals 2770 provided at either end of the straight jumper tube are in sealing engagement with each of the first fluid supply passages in which they extend and so that the right edge of the shoulder 2752 is pressed against the port provided at the mouth of the first fluid supply passage of the adjacent rocker shaft. The clamping ring 2780 may then be moved to the left and secured in an annular recess provided on the body of the straight jumper tube 2750 so that the straight jumper tube 2750 is locked in place between two rocker shafts. Hydraulic fluid may then flow between the two rocker shafts through the internal hydraulic passage 2760.

Figure 27:
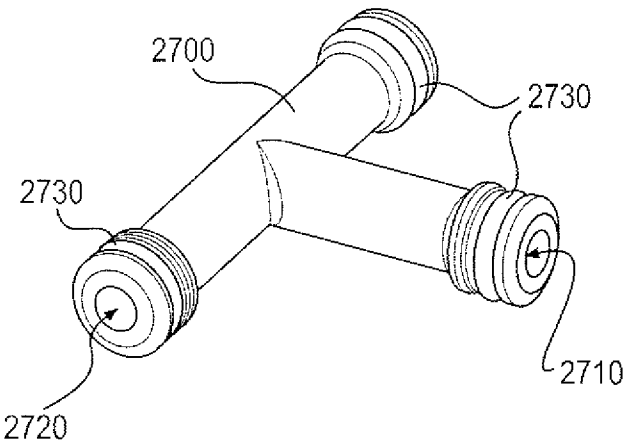
FIG. 27 is a pictorial view of a T-jumper tube used to connect a solenoid valve and rocker shafts used in the system for actuating one or more engine valves shown in FIGS. 22-25.

FIG. 27 is a pictorial view of a T-jumper tube 2700. The T-jumper tube 2700 may include internal hydraulic passages 2710 and 2720, hydraulic seals 2730, and one or more clamping rings (shown in FIG. 26). The T-jumper tube 2700 may be installed in a similar fashion to that of the straight jumper tube shown in FIG. 26, by sliding one end into the first fluid supply passage 2510 (FIG. 24) of a rocker shaft 2500. Thereafter, the T-jumper tube 2700 may be retracted out of the first fluid supply passage 2510 until the opposite end of the tube enters the first fluid supply passage of an adjacent rocker shaft so that the seals 2730 provided at either end of the T-jumper tube are in sealing engagement with each of the first fluid supply passages into which they extend. The middle portion of the T-jumper 2700 may be inserted into a hydraulic port provided on the solenoid valve assembly and the solenoid valve assembly may be secured to the engine cylinder head using one or more bolts so that the T-jumper tube is locked in place between two adjacent rocker shafts. Hydraulic fluid may then flow between the solenoid valve 2600 and the two adjacent rocker shafts through the internal hydraulic passages 2710 and 2720.

The system for actuating one or more valves illustrated in FIGS. 22-27 may be operated as follows to selectively actuate an engine valve, such as, but not limited to the exhaust valve 2420. With reference to FIG. 22 in particular, the pedestal assembly 2100 is shown in a state during which no engine valve actuation is desired. During this state, the solenoid valve 2600 may be de-energized so that the supply of hydraulic fluid to each of the plurality of pedestal assemblies 2100 through the external hydraulic tubing (T-jumper tubes 2700 and straight jumper tubes 2750) is cut off. As a result, there is insufficient hydraulic pressure in the lost motion housing supply passage 2140 to move the control valve assembly 2200 upward against the bias of the first control valve spring 2240. In turn, hydraulic fluid is not supplied to the actuator piston assembly 2300, and the actuator piston spring 2340 biases the actuator piston collar 2330 and actuator piston 2310 upward creating lash space 2350 between the lower surface of the actuator piston 2310 and the valve bridge pin 2410. During this state, the exhaust valve 2420 is only actuated by the exhaust rocker arm 2800 through the valve bridge 2400.

When valve actuation using the system shown in FIGS. 22-27 is desired, the solenoid valve 2600 may be selectively energized under control of an engine control module or the like so that hydraulic fluid is supplied to each of the plurality of pedestal assemblies 2100 through the external hydraulic tubing (T-jumper tubes 2700 and straight jumper tubes 2750) from a hydraulic fluid supply (not shown) such as the engine oil sump. As a result, hydraulic pressure is created in the lost motion housing supply passage 2140 sufficient to move the control valve assembly 2200 upward against the bias of the first control valve spring 2240 as shown in FIG. 23. In turn, hydraulic fluid is supplied to the actuator piston assembly 2300. As hydraulic fluid enters the hollow interior of the actuator piston 2310, the actuator piston is forced downward against the bias of the actuator piston spring 2340, taking up the lash space 2350 between the lower surface of the actuator piston 2310 and the valve bridge pin 2410. When the exhaust valve 2420 is next actuated by the exhaust rocker arm 2800, the hydraulic pressure in the actuator piston 2310 causes it to translate down further, and the valve bridge pin 2410 follows the valve bridge 2400 downward until the actuator piston collar 2330 seats against the enlarged head portion of the lash screw 2320. When the valve bridge 2400 returns upward under the control of the exhaust rocker arm 2800, the actuator piston 2310 maintains the exhaust valve 2420 open because it is hydraulically locked into a position that keeps the valve bridge pin 2410 translated in a downward position. The exhaust valve 2420 may be maintained open in this manner to provide bleeder braking, or partial bleeder braking under the control of the solenoid valve 2600.

Figure 28:
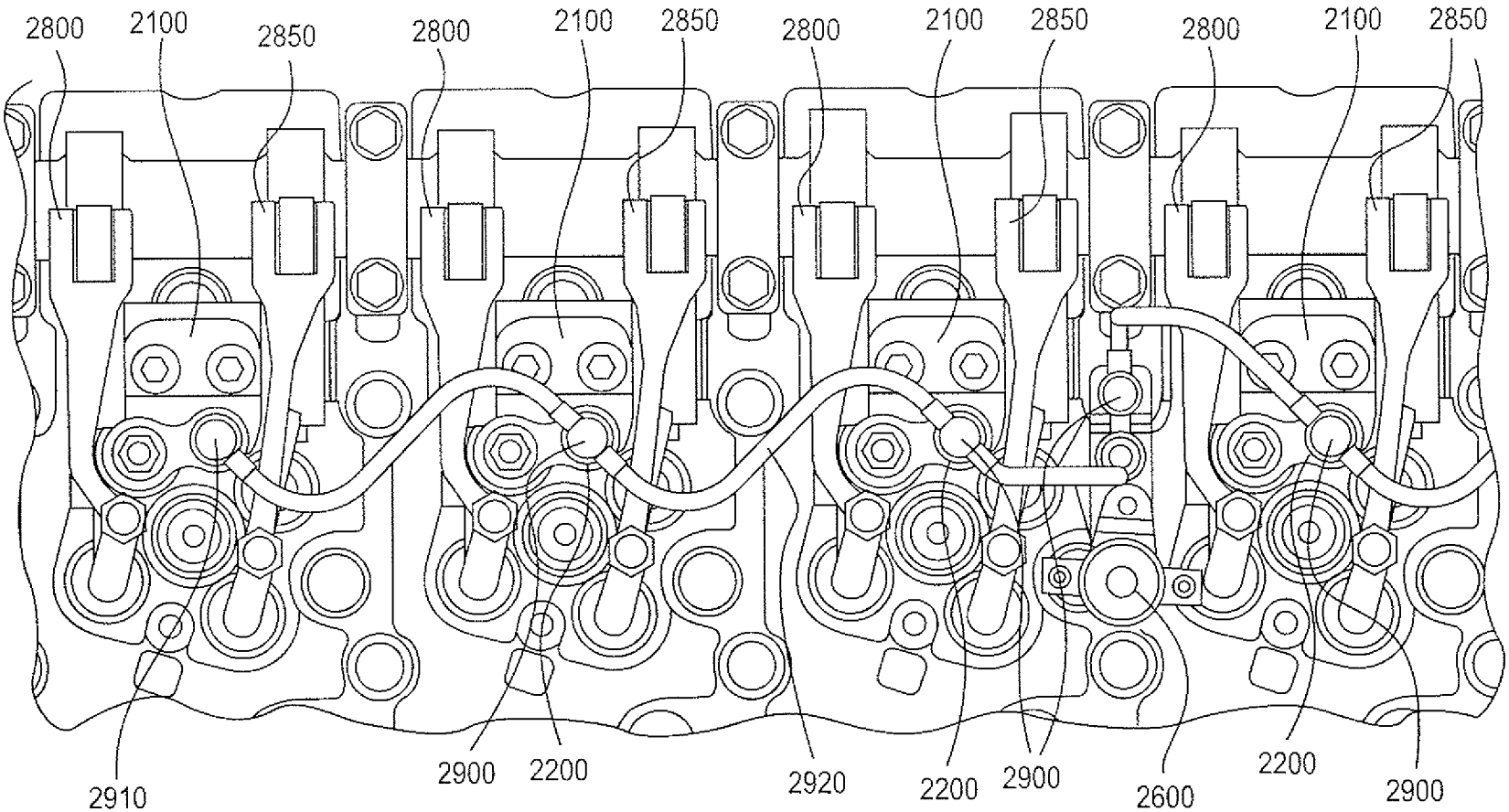
FIG. 28 is an overhead pictorial view of a still further alternative engine valve actuation system having a plurality of the lost motion housings of the type shown in FIGS. 22-24 connected by external hydraulic fluid tubing.

A further alternative embodiment of the system shown in FIGS. 22-27 is shown in FIG. 28, in which like reference characters identify like elements shown in other figures. The embodiment in FIG. 28 differs from that shown in FIG. 25 in the following manner. In the FIG. 28 embodiment, the rocker shafts on which the pedestal assemblies 2100 are mounted do not include the first and second fluid supply passages 2510 and 2520. Instead, hydraulic fluid connectors 2900 and 2910 are provided on the solenoid valve 2600 and on the control valve assemblies 2200. External hydraulic fluid tubing 2920 extends between the solenoid valve 2600 and the two adjacent control valve assemblies 2200, as well as between each successive pair of control valve assemblies. As a result, hydraulic fluid may be provided from the solenoid valve 2600 to each of the pedestal assemblies 2100 exclusively through the external hydraulic fluid tubing 2920. In the FIG. 28 embodiment, the control valve assemblies 220 may be inverted as compared to the orientation of the same assemblies shown in FIGS. 22-24.

It will be apparent to those skilled in the art that variations and modifications of the present invention can be made without departing from the scope or spirit of the invention.

What is claimed is:

1. A system for actuating one or more engine valves, comprising:

a rocker shaft having a hydraulic fluid supply circuit extending through the rocker shaft to a port on the outer surface of the rocker shaft;

a solenoid valve adapted to selectively supply hydraulic fluid to the rocker shaft hydraulic fluid supply circuit;

a lost motion housing disposed about the rocker shaft, wherein the lost motion housing is incorporated into a rocker shaft pedestal, said lost motion housing having a lower pedestal portion adapted to contact a cylinder head, an actuator piston bore, a control valve bore, and an internal hydraulic circuit extending from the actuator piston bore to the control valve bore and from the control valve bore to the port on the outer surface of the rocker shaft;

means for securing the lost motion housing in a fixed position relative to the rocker shaft;

an actuator piston assembly disposed in the actuator piston bore;

a control valve assembly disposed in the control valve bore; and external hydraulic fluid tubing provided between the solenoid valve and the control valve.

2. The system of claim 1, further comprising an anti-rotation pin extending through the lost motion housing collar and into the rocker shaft.

3. The system of claim 2, further comprising:

two adjacent rocker shafts each having a hydraulic fluid supply circuit extending longitudinally through the rocker shaft to ports on the outer surfaces of the rocker shaft; and wherein said external fluid tubing comprises a straight jumper tube extending between a port of each of the two adjacent rocker shafts, said straight jumper tube having an internal hydraulic passage providing hydraulic communication between the hydraulic fluid supply circuits of the two adjacent rocker shafts.

4. The system of claim 3, further comprising:

a third rocker shaft adjacent to one of the two adjacent rocker shafts, said third rocker shaft having a hydraulic fluid supply circuit extending longitudinally through the rocker shaft to a port on the outer surface of the third rocker shaft; and wherein said external fluid tubing comprises a T-jumper tube extending between a port of the third rocker shaft and the port of an adjacent one of the two adjacent rocker shafts, said T-jumper tube having an internal hydraulic passage providing hydraulic communication between the hydraulic fluid supply circuits the third rocker shaft and the adjacent one of the two adjacent rocker shafts and the solenoid valve.

5. The system of claim 4, wherein the actuator piston assembly comprises:

a lash screw extending through the lost motion housing into the actuator piston bore, said lash screw including an enlarged lower portion;

an actuator piston having a hollow interior for receiving the enlarged lower portion of the lash screw;

an actuator collar connected to the actuator piston in the hollow interior of the actuator piston, said actuator collar having a central opening surrounding the lash screw; and a spring provided between the actuator collar and the enlarged lower portion of the lash screw in the hollow interior of the actuator piston.

6. The system of claim 1, further comprising:

two adjacent rocker shafts each having a hydraulic fluid supply circuit extending longitudinally through each of the rocker shafts to ports on the outer surfaces of the rocker shafts; and wherein said external fluid tubing comprises a straight jumper tube extending between a port of each of the two adjacent rocker shafts, said straight jumper tube having an internal hydraulic passage providing hydraulic communication between the hydraulic fluid supply circuits of the two adjacent rocker shafts.

7. The system of claim 6, further comprising hydraulic fluid seals provided at ends of the straight jumper tube, said seals adapted to engage the ports on the outer surfaces of the rocker shafts.

8. The system of claim 1, further comprising:

two adjacent rocker shafts each having a hydraulic fluid supply circuit extending longitudinally through each of the rocker shafts to ports on the outer surfaces of the rocker shafts; and wherein said external fluid tubing comprises a T-jumper tube extending between a port of each of the two adjacent rocker shafts, said T-jumper tube having an internal hydraulic passage providing hydraulic communication between the hydraulic fluid supply circuits of the two adjacent rocker shafts and the solenoid valve.

9. The system of claim 8, further comprising hydraulic fluid seals provided at ends of the T-jumper tube, said seals adapted to engage the ports on the outer surfaces of the rocker shafts and a port in hydraulic communication with the solenoid valve.

10. The system of claim 1, wherein the actuator piston assembly comprises:

a lash screw extending through the lost motion housing into the actuator piston bore, said lash screw including an enlarged lower portion;

an actuator piston having a hollow interior for receiving the enlarged lower portion of the lash screw;

an actuator collar connected to the actuator piston in the hollow interior of the actuator piston, said actuator collar having a central opening surrounding the lash screw; and a spring provided between the actuator collar and the enlarged lower portion of the lash screw in the hollow interior of the actuator piston.

11. A system for actuating one or more engine valves comprising:

a plurality of rocker shafts, each of said rocker shafts having a hydraulic fluid supply circuit extending through the rocker shaft to a port on the outer surface of the rocker shaft;

a plurality of lost motion housings, each of said plurality of lost motion housings comprising a rocker shaft pedestal and being disposed about a respective one of the plurality of rocker shafts, each of said lost motion housings having a collar surrounding a respective one of the plurality of rocker shafts, a lower pedestal portion adapted to contact a cylinder head, an actuator piston bore, a control valve bore, and an internal hydraulic circuit extending from the actuator piston bore to the control valve bore and from the control valve bore to the port on the outer surface of the rocker shaft;

means for securing each of the plurality of lost motion housings in a fixed position relative to a respective one of the plurality of rocker shafts;

a plurality of actuator piston assemblies, each disposed in a respective one of the actuator piston bores;

a plurality of control valve assemblies, each disposed in a respective one of the control valve bores;

a solenoid valve;

a T-jumper tube extending between a first and second of the plurality of rocker shafts and the solenoid valve, said T-jumper tube having an internal hydraulic passage providing hydraulic communication between the hydraulic fluid supply circuits of the first and second of the plurality of rocker shafts and the solenoid valve; and a straight jumper tube extending between the second and a third of the plurality of rocker shafts, said straight jumper tube having an internal hydraulic passage providing hydraulic communication between the hydraulic fluid supply circuits of the second and third of the plurality of rocker shafts.

12. The system of claim 11, further comprising:

hydraulic fluid seals provided at ends of the straight jumper tube, said seals adapted to engage the ports on the outer surfaces of the second and third of the plurality of rocker shafts; and hydraulic fluid seals provided at ends of the T-jumper tube, said seals adapted to engage the ports on the outer surfaces of the first and second of the plurality of rocker shafts.

13. The system of claim 12, wherein each of the plurality of actuator piston assemblies comprises:

a lash screw extending through the lost motion housing into the actuator piston bore, said lash screw including an enlarged lower portion;

an actuator piston having a hollow interior for receiving the enlarged lower portion of the lash screw;

an actuator collar connected to the actuator piston in the hollow interior of the actuator piston, said actuator collar having a central opening surrounding the lash screw; and a spring provided between the actuator collar and the enlarged lower portion of the lash screw in the hollow interior of the actuator piston.

14. The system of claim 11, wherein each of the plurality of actuator piston assemblies comprises:

a lash screw extending through the lost motion housing into the actuator piston bore, said lash screw including an enlarged lower portion;

an actuator piston having a hollow interior for receiving the enlarged lower portion of the lash screw;

an actuator collar connected to the actuator piston in the hollow interior of the actuator piston, said actuator collar having a central opening surrounding the lash screw; and a spring provided between the actuator collar and the enlarged lower portion of the lash screw in the hollow interior of the actuator piston.

15. A system for actuating one or more engine valves comprising:

a plurality of rocker shafts;

a plurality of lost motion housings, each of said plurality of lost motion housings comprising a rocker shaft pedestal and being disposed about a respective one of the plurality of rocker shafts, each of said lost motion housings having a collar surrounding a respective one of the plurality of rocker shafts, a lower pedestal portion adapted to contact a cylinder head, an actuator piston bore, a control valve bore, and an internal hydraulic circuit extending from the actuator piston bore to the control valve bore;

means for securing each of the plurality of lost motion housings in a fixed position relative to a respective one of the plurality of rocker shafts;

a plurality of actuator piston assemblies, each disposed in a respective one of the actuator piston bores;

a plurality of control valve assemblies, each disposed in a respective one of the control valve bores;

a solenoid valve;

a hydraulic fluid supply in hydraulic communication with the solenoid valve;

a first external hydraulic fluid tube extending from the solenoid valve to a first one of the plurality of control valve assemblies; and a second external hydraulic fluid tube extending from the first one of the plurality of control valve assemblies to a second one of the plurality of control valve assemblies.

16. The system of claim 15 wherein the solenoid valve is adapted to be mounted on the cylinder head.

17. The system of claim 16 further comprising a third external hydraulic fluid tube extending from the solenoid valve to a third one of the plurality of control valve assemblies.

18. The system of claim 15 further comprising a third external hydraulic fluid tube extending from the solenoid valve to a third one of the plurality of control valve assemblies.

* * * * *